United States Patent [19]

Thielois

[11] Patent Number: 4,938,533

[45] Date of Patent: Jul. 3, 1990

[54] UPRIGHT AND SEATING POSITIONING DEVICE WITH PARTICULAR APPLICATION TO ARMCHAIRS, CHAIRS OR FIXED OR MOBILE SEATS

[75] Inventor: Alain Thielois, Lyons, France

[73] Assignee: Leveur S.A.R.L., France

[21] Appl. No.: 336,511

[22] Filed: Apr. 11, 1989

Related U.S. Application Data

[63] Continuation of Ser. No. 125,992, Nov. 27, 1987, abandoned.

[30] Foreign Application Priority Data

Dec. 1, 1986 [FR] France ..... 86 16955

[51] Int. Cl.[5] ..... A47C 1/02

[52] U.S. Cl. ..... 297/337; 297/DIG. 10; 248/404

[58] Field of Search ..... 297/337, 338, DIG. 10; 4/578, 579, 566; 248/404, 155.2; 182/182

[56] References Cited

U.S. PATENT DOCUMENTS

| | | | |
|---|---|---|---|
| 2,779,949 | 2/1957 | Crispen | 248/404 X |
| 3,158,398 | 11/1964 | Stryker | 297/337 |
| 4,453,766 | 6/1984 | DiVito | 297/DIG. 10 |
| 4,552,404 | 11/1985 | Congleton | 297/DIG. 10 |
| 4,613,187 | 9/1986 | Gordon | 297/195 |
| 4,637,654 | 1/1987 | Boardman | 297/337 |

*Primary Examiner*—Peter A. Aschenbrenner
*Attorney, Agent, or Firm*—Eric P. Schellin

[57] ABSTRACT

The invention relates to an upright positioning structure with a pushing bar applying the upright positioning and pushing effort to the sub femoral area (3) and more particularly the ischial-femoral angle (3) of the user, pressing against the ischial projections of the user's pelvis and providing a resistance to forward sliding during the lifting up movement, the buttock and lumbar region of the user remaining outside of the pushing bar and unsupported.

This structure is particularly applied to armchairs or fixed or mobile seats.

1 Claim, 5 Drawing Sheets

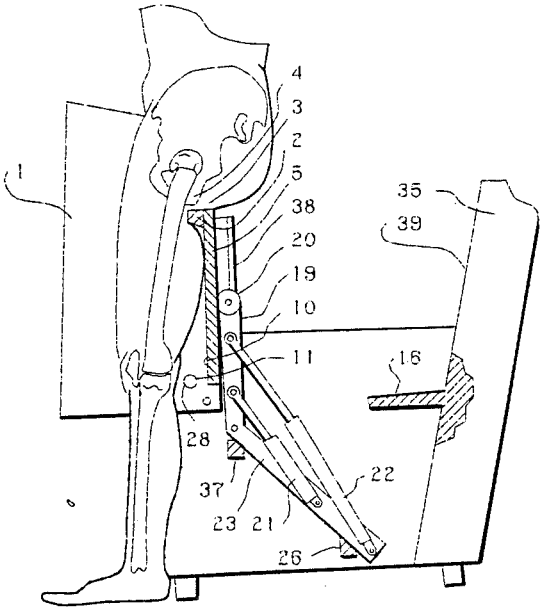
Fig. 1
Fig. 3
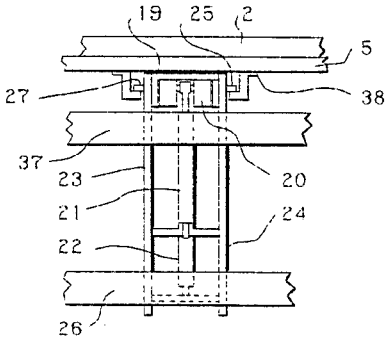
Fig. 2
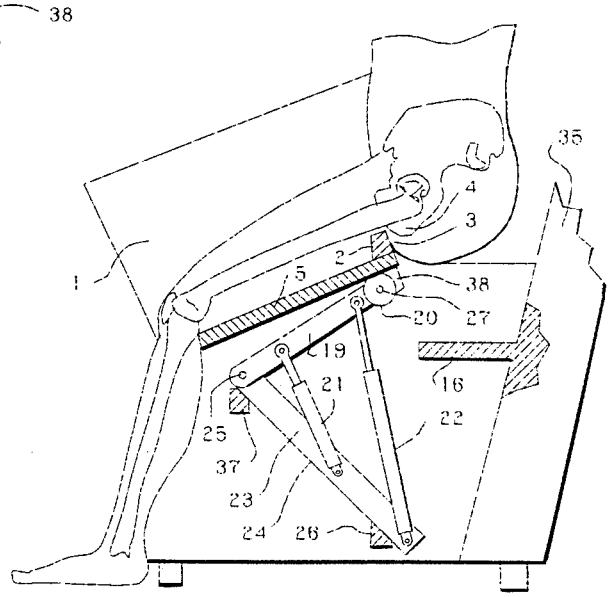

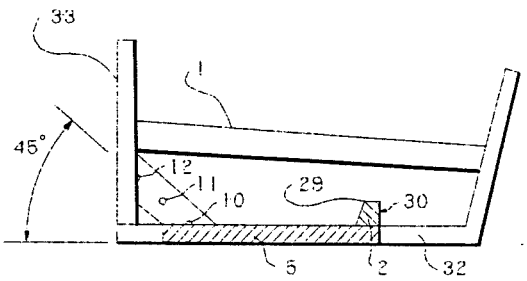
Fig:4
Fig:5
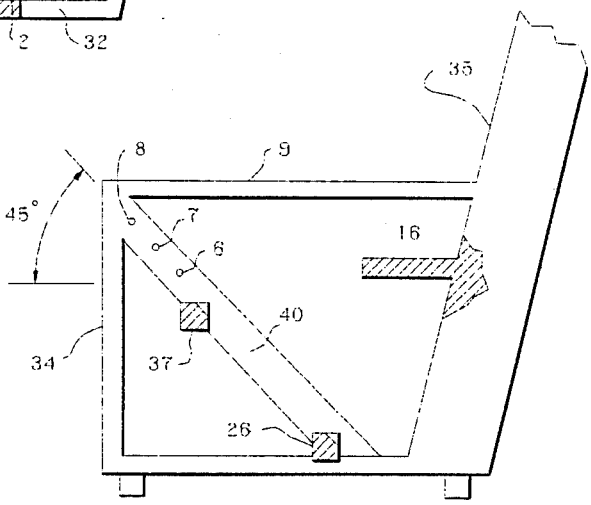
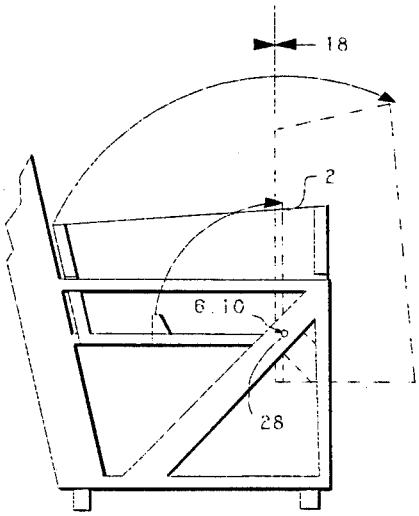
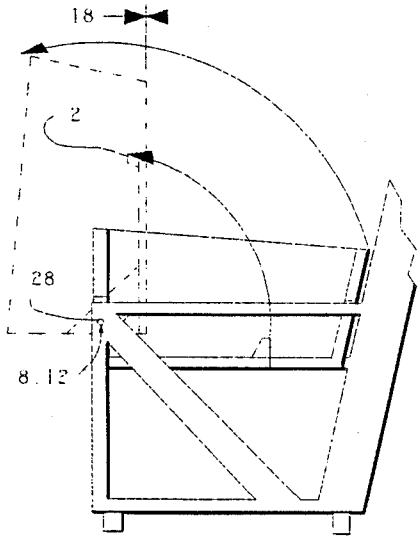
Fig:6 1
Fig:6 2

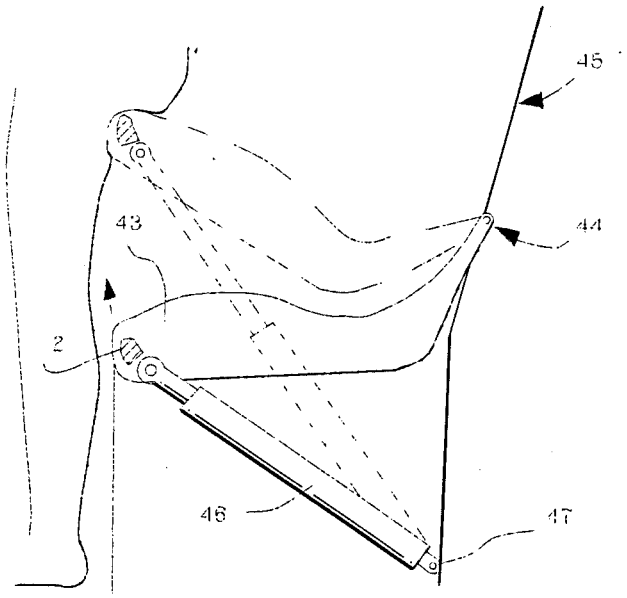
Fig. 9
Fig. 10
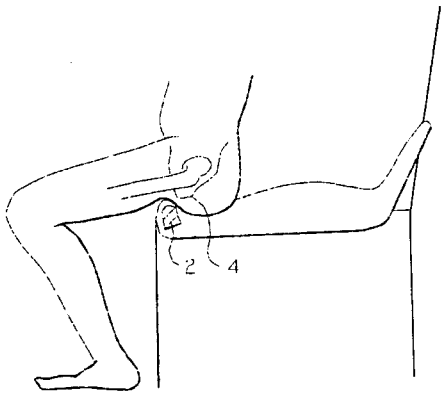
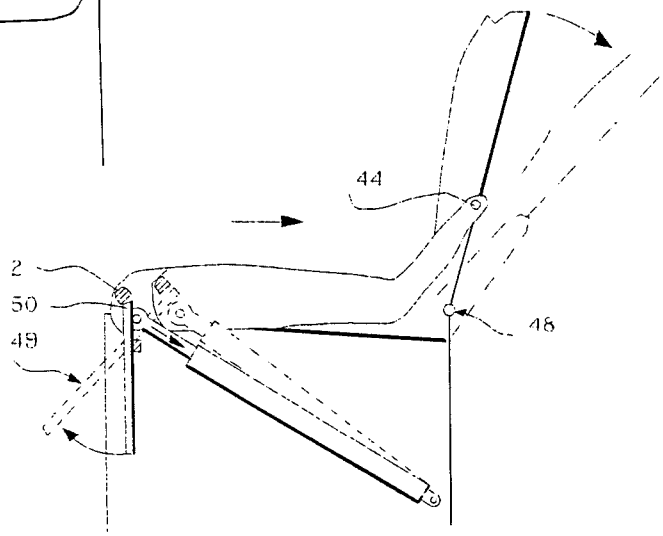
Fig. 11

Fig. 12
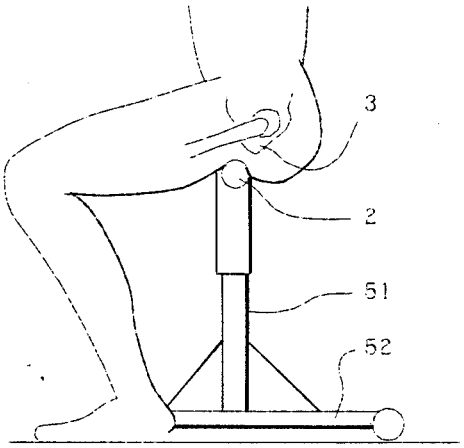
Fig. 13
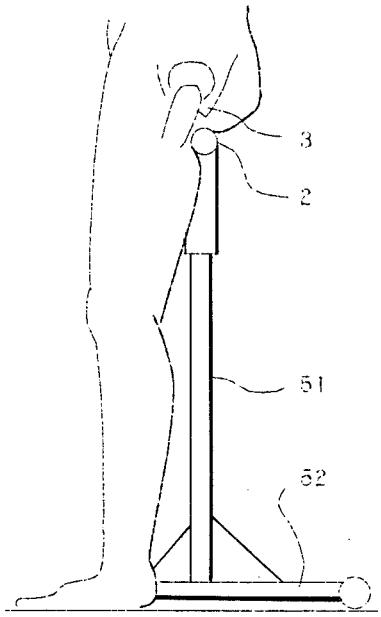
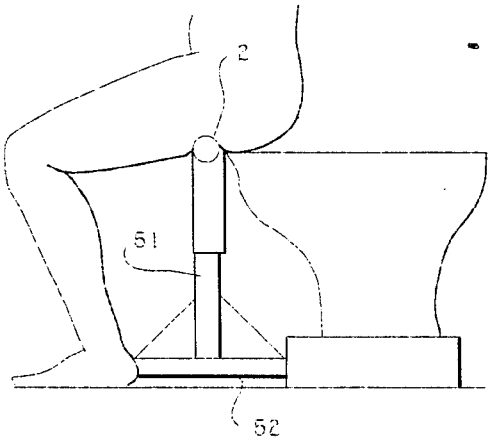
Fig. 14
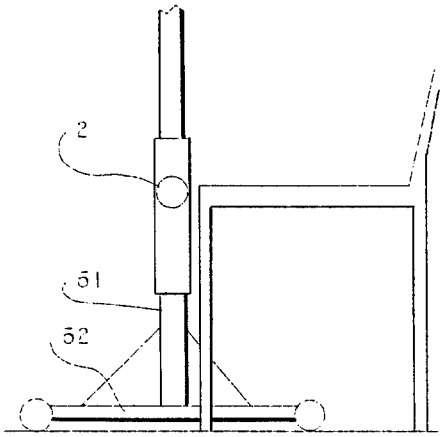
Fig. 15

UPRIGHT AND SEATING POSITIONING DEVICE WITH PARTICULAR APPLICATION TO ARMCHAIRS, CHAIRS OR FIXED OR MOBILE SEATS

This application is a continuation of application Ser. No. 125,992, filed 11/27/1987, abandoned.

BACKGROUND OF THE INVENTION

This invention relates to an upright and seating positioning device with particular application to armchairs, chairs or fixed or mobile seats. This invention is meant for old aged people, the handicapped or invalids capable however, of some movement on their own.

In the application considered for armchairs, some using an upright positioning device are known and are described for example in French patents Nos. 2.513.499, 2.553.650, German DE No. 33 10429 and al. or INTERNATIONAL PCT/SE82/00111. Several of the aforementioned use the system of rotating the seat of the armchair around its top front part either associated or not associated with a movement in conjuction with the back. The action of the seat being lifted up has the disadvantage of turning into a tilted plane from which the user tends to slip.

The lifting up movement of the seat either has to be interrupted long before being in the vertical position thus not fulfilling its function, or the user has to be fastened into the chair by means of straps or stops when the accentuated tilting of the seat is required.

This process is restrictive and hardly discreet when endeavouring to conceal a handicap is required.

The lifting up techniques of certain of these processes entail a complex movement of the front face of the seat, moving it substantially beyond the vertical plane of the front face of the armchair. This motion induces permanent sliding of the seat with respect to the user's body. It has the disadvantage of distorting the optimum cinematic tract at the level of the legs of the patient.

With other processes, the armchair seat or part of the seat, remains horizontal whereas it creates a combined movement from the bottom to the top and from the rear towards the front face of the armchair. This movement means only one pratical upright lifting height of the front face of the armchair can be reached and therefore, is only suitable for one height of user.

SUMMARY OF THE INVENTION

This invention is aimed at remedying these disadvantages.

In a more general manner, the invention aims at a lifting up device capable of being used on its own so that the user is in a determined position with respect for example to another resting or sitting plane.

In the event of the application and integration of the device according to the invention, to an armchair or seat, another object of the invention is to suppress the need for the majority of users to be fastened into the armchair during upright positioning.

An additional object is to include the invention in the lines of a normal looking armchair.

In order to fulfil the aforementioned objectives, the object of the invention stands out in that it advantageously uses a feature of the human anatomy. According to the invention, the locus of application of the lifting up and support effort of the user during the upright movement is selected in the sub-femoral area (3) in particular FIGS. 1 and 3. In fact, with someone in the seated position, observed from the side, the two ischial points (4) of the pelvis (FIGS. 1 and 3) project by few centimeters under the plane of the rear face of the body of the femurs, and form, with this plane, an angle, slightly greater than 90° on which the summit can be easily reached by pressing the flesh into the area concerned.

These two ischial projections (4), hooked on by an adapted profile, give safe and positive support points and become excellent retaining points preventing the user from sliding towards the front during the whole upright positioning phase.

This is defined as being situated close to the joint locus of legs on the pelvis, this support area is closer to the natural cinematic tract of the user than a system which is applied under the end of the buttocks. Thus it enables the user to use his muscular dynamics to the best of their ability. After the movement relating to the iliac bone and pelvis, when the patient straightens himself up, the depth of the ischial projection under the femurs tends to be reduced whereas its angle with the place of the femurs is increased.

In order to hold the user properly until the end of the movement, it is necessary to define such a pushing system profile in that it becomes inserted into the ischial-femoral angle under the effect of the user's weight and remains there until the end of the lifting up rotation.

DETAILED DESCRIPTION OF THE INVENTION

So, according to a first embodiment, the invention is aimed at a device comprising of an upright lifing and pushing structure wherein it is provided with a pushing bar which applies the upright lifting and pushing force to the sub femoral area and in particular, the ischial femoral angle of the user, pressing against the ischial projections of the pelvis of the user providing a resistance to the forward sliding movement during lifting up, the buttock and lumbar region of the user remaining at the end of the pushing bar.

According to another embodiment in the application of the invention to an armchair or seat, the invention is aimed at an armchair or fixed or mobile seat of the type comprising of a seat and upright lifting and pushing structure associated to the seat and an armchair framework on which it is hinged around a horizontal pin wherein the seat in one or more parts, fixed and mobile, is provided with a pushing bar which applies the upright lifting and pushing effort to the sub femoral area and particularly to the ischial femoral angle of the user, pressing against the ischial projections of the user's pelvis providing a resistance to the forward sliding movement during lifting up, the buttock and lumbar area remaining at the end of the pushing bar.

According to another arrangement and in a first embodiment, the pushing bar is situated in a horizontal plane at the rear end of the mobile seat and parallel to the rotating and pivoting axis of the latter, the pushing bar being built up, embodied or belonging directly to the rear part of the mobile seat.

The seat is comprised of the armchair and a front part which is mobile around a pin fitted at the front of the armchair and a second part of a seat fixed in a horizontal plane, situated between the pushing bar and the back of the armchair.

According to this arrangement and another embodiment, the pushing bar is situated on the front face of the seat. This is solid and is hinged around a parallel pin, its front face is situated in the back of the armchair.

Another feature of the invention is that the sub femoral pushing system generally only takes the lifting up load of the patient. With this purpose, the system is made to project as soon as the rotation movement of the seat is started within the frame of the application of the invention to an armchair or seat.

A non-exclusive method of making the pushing system to project is to produce the seat of the armchair in two parts initially belonging to the same horizonal plane. A front part (5), hinged around its pin (28) and a second seat part (16), situated between the pushing bar and the back (35) of the armchair. This second part could be either fixed and integral with the back, FIG. 1, or hinged around the rear face of the front part of the seat.

In either case, the rotating of the front part of the seat will create, by a relative translating or rotating movement of the two parts 1 and 16 of the whole of the seat, a free space at the rear of the pushing bar which will become the only active part.

The object of this space is to freely house the buttock and lumbar region of the user without this region being restricted. Its function is to prevent a substantial pushing component from being applied to the end of the user's buttocks, tending to expell him from the pushing bar when the seat is very tilted after pivoting.

An additional object of the invention in the application concerned with armchairs and with the certain embodiment of a pushing bar fitted at the rear end of the mobile steat, is the adaptability to the morphology and height of different users.

According to the surveys, the height which must be reached by the pushing point of the lifting up system substantially vertical to the rotation axis of the seat, must be in the region of approximately 60 and 90 cm.

The height required will be obtained by adding the height from the floor to the rotation axis (28) of the seat (1), and the distance from this axis to the rear part of the pushing bar (2) integral with the seat in its rotation movement. It is thus sufficient to vary either one or the other, or both these two dimensions at once in order to vary to the same value, the lifting up height to the pushing bar.

The rotation axis/pushing bar distance can be adjusted to the length of the thigh of the user just as with the height from the floor to this axis can be adjusted to the height of his tibia and ankle. The total of these two dimensions correspond to the height from the floor to the user's sub femoral area (3) when he is standing up.

In order to implement the invention, the simultaneous varying of the two dimensions was selected.

A remarkable anatomic property is that, to a given variation of the length of the femur, corresponds a variation practically identical to the length of the tibia.

If we determine the position of a first pair of locations (6) and (10) of the rotation axis (28) of the seat (1) of the chair on the frame (9) of the armchair, so that the height from the floor to the rotation axis corresponds to the length of the tibia plus ankle of the smallest person to be lifted up, we determine a distance from this axis (28) to the pushing bar (2) so that it corresponds to the sub femoral length of this person, whereas in order to properly vertically lift up anyone who is taller, the geometric locus of the locations of the rotation axis (28) will be a tilted 45° plane passing through the centre of the first location of the axis (28) and moving away towards the front top part of the front face of the armchair.

The number of pairs of locations of the rotation axis on the mobile seat and the framework (9) of the armchair will be determined in function of the precision of verticalisation required.

The pairs of locations will have two additional characteristics: firstly they determine axes which remain localised close to the axis of knee joints of users, which is comfortable, secondly, the lower face of the plate (5) of the hinged seat (1) will always pass in the same vertical plane (18) during the lifting up rotation of the seat whatever the pair of locations of the rotation axis of the seat on the armchair used.

This feature is used in a case of preferred embodiment of the invention where the mobile lever (19) of the mechanism (24), moves over a constant arc of a circle near to 90°, whereas the end of this lever (19) fitted with contact rollers (20), is moved in relation to the seat under the plate (5) of the latter. The same mechanism can be used as it is without modifying its positioning regardless of the choice of pair of locations of the rotation axis and despite a substantial extension of the movement of the seat for tall people.

The choice of positioning of rotation axis locations of the swivelling seat (1) over a 45° tilted plane above the seat, means that a normal looking armchair can be used.

These features and others will appear as the specification proceeds.

In order to clarify the object of the invention, however without limiting it, it is illustrated by the accompanying drawings in which:

FIG. 1 shows the application of the invention to an armchair or seat and shows the mobile seat at the end of the upright positioning sequence. It illustrates the action of the pushing bar (2) under the ischium bottom ends (4), after the flesh has been pressed into the sub femoral (3) area.

FIG. 2 is a front view of the lifting up mechanism.

FIG. 3 represents the mobile seat at the beginning of an upright positioning sequence according to FIG. 1.

FIG. 4 is a section according to the longitudinal symmetry plane along the centre line of the structure of the mobile seat (1), showing three possible locations (10, 11 and 12) of the rotation axis (28) when applying the invention to an armchair or seat.

FIG. 5 is a section according to the longitudinal symmetry plane along the centre line of the framework (9) of the armchair showing three possible locations (6, 7, 8) of the rotationaxis (28) when applying the invention to an armchair or seat.

FIGS. 6.1, 6.2 comparatively show the extreme heights reached by the pushing bar after rotation of the mobile seat (1) around the pin (28) successively positioned in the pairs of locations 6/10 and 8/12 respectively corresponding to the smallest and tallest heights which can be vertically lifted up, when applying the invention to an armchair or seat.

Figure 7:
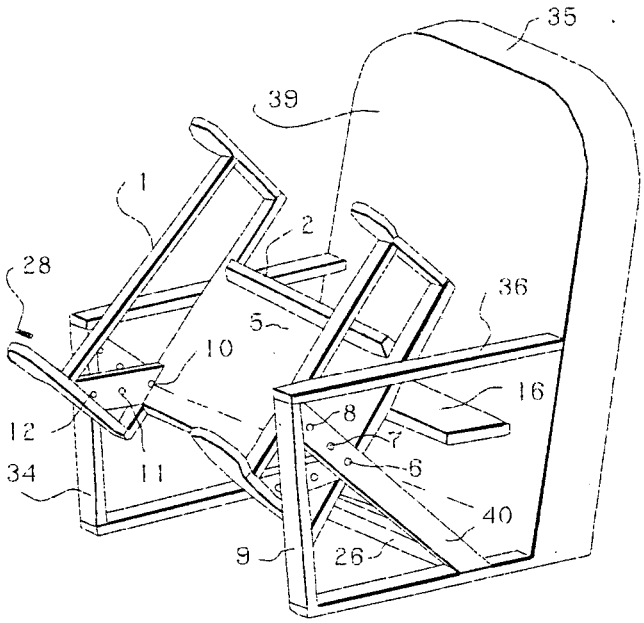

FIG. 7 is a perspective view of the armchair and its mobile seat in rotation around the pin (28) positioned in the pair of locations 6/10 when applying the invention to an armchair or seat.

Figure 8:
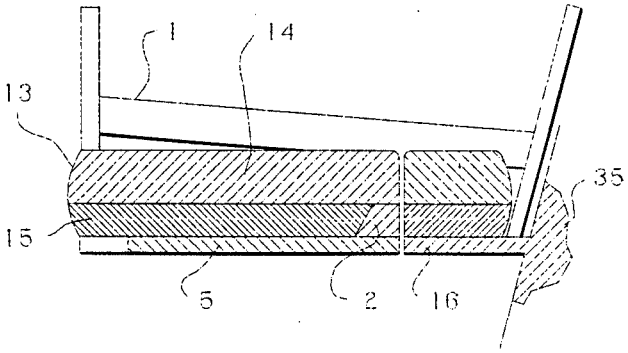

FIG. 8 is a sectional view of the seat (1) and the cushion (13) according to their plane along the centre line. It illustrates the integration of the bar (2) into the thickness of the cushion (13) comprised of two foam pads of different densities (15 and 14) when applying the invention to an armchair or seat.

FIG. 9 is a schematic view illustrating an alternate embodiment of the invention applied to an armchair or seat.

FIG. 10 is a schematic view complementary to FIG. 9, illustrating the positioning of the user before applying the upright positioning effort.

FIG. 11 is a schematic view complementary to FIGS. 9 and 10, illustrating the tilting of the seat when implementing the upright positioning device.

FIGS. 12 and 13 illustrate the upright positioning device according to the invention in its main concept.

FIGS. 14 and 15 illustrate the device according to FIGS. 12 and 13 within the use which can be made of it.

Figure 16:
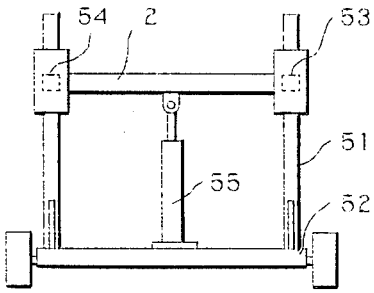

FIG. 16 is a front view of the device according to FIGS. 12 and 13.

In the case of embodiment, the armchair which is symmetric in respect to its plane along the centre line, is provided with a swivelling seat (1) hinged in rotation on the framework (9) of the armchair around a horizontal pin (28). The position of the rotation pin (28) can be chosen from several mating pairs of coupled locations 6/10, 7/11 and 8/12 of which 6–7 and 8 belong to the frameworks (9) and (10), (11) and (12) with the mobile seat (1) is which the user can position the pin (28) when the seat (1) is in the rest position; i.e. its plate (5) is horizontal, its front face (33) in the same plane as the front face (34) of the framework (9) and the angles $\alpha$ and $\beta$ of the seat (1) and framework (9) of the armchair observed from the side are superimposed.

Each pair of locations, purposely limited to 3 in the description in order to understand the drawings more easily, corresponds to a different height which the pushing bar (2) reaches when it cross the planes (18) which marks the end and apex of its stroke.

The seat (1) is made up of a plate (5) comprising, at its rear end, a sub femoral pushing bar (2) projecting, above the plane of the plate and long enough in order to enable the simultaneous supporting of the two ischiums. This bar (2) is integrated into the thickness of the cushion (13), made up of a lower plate (15) of foam of a density greater than that of the lower plate (5) so as not to hurt the user during usage or to be uncomfortable in the seated position. The profile of this bar can be cylindrical or polygonal.

The faces (29) and (30) of the pushing bar (2) form between themselves, a right hand angle, the summit of which is rounded off so as not to hurt the user. The pushing bar is parallel to the front face of the seat (1). The swivelling seat (1) comprises 3 locations (10, 11 and 12) of the pin (28) situated in the same plane forming a $\alpha$ angle of 45° with the plate (5) of the seat (1).

The distance from the axes of the locations (10, 11 and 12) to the front plane (33) of the seat (1), FIG. 4, is the same as the distance from their corresponding respectives (6, 7, 8) to the plane of the front face (34) of the framework (9), FIG. 5. The tilting angle $\beta$ of these locations with the plane of the seat (1) in the rest position is 45°.

The free space (32), situated at the rear of the pushing bar (2), is provided to take the fixed part (16) of the seat so that the cooperation of the mobile seat (1), in the rest position, with the fixed part (16), creates a single plane where the user can sit.

The space between the face (30) of the pushing bar and the front face of the back of the armchair is advantageously in the region of 15 cm when the seat (1) is in the rest position. This distance must always be greater than 7 cm.

In the case of the described embodiment, the arm rests are integral with the mobile seat (1); their enveloping appearance is reassuring for the user. However, an invention can be produced with fixed arm rests, integral with the framework (9) if lifting up effort is provided by the pushing bar (2) alone.

The framework (9) of the armchair, symmetry with respect to its plane along the centre line, comprises of two sides (36) and a back (35) which the fixed part (16) of the seat is integral with. The back (35) can be tilted according to known techniques.

A brace (40) tilted at 45° with respect to the horizontal, supports the locations (6, 7 and 8) of the rotation pin (28). This brace is made up of a connection between the lower, upper and front parts of the sides (36). The two braces (40) in addition, support the cross members (26) and (37) and stiffen the armchair assembly.

The cross members (26) and (37) act as supports to the mechanism (24).

A lifting up mechanism (24), acting as a caliper, FIGS. 1, 2 and 3, comprises a leg (23), fixed and integral with the framework (9) and a leg (19) rotating around the pin (25). Motors (21) and (22), between the legs (23) and (19) cause, on request from the user, the opening or closing of the caliper between the extreme positions of the leg (19).

One or several rollers (20), hinged on their pin (27), situated at the end of the leg (19), transmit the lifting push under the plate (5) of the mobile seat, whilst moving in relation with it during its movements.

The motors (21) can comprise for example, of different types of cylinders or similar components. A cylinder embodiment, possibly telescopic, can apply its pushing force directly between a fixed point of the plate (5) of the seat (1) and the cross member (26) of the framework (9) of the armchair, without having to use an additional mechanical intermediate component. The mobile seat (1) is returned towards the horizontal position at no load by the end of the pin (27) on the rabbets (38) intergral with the plate (5).

The pushing bar can be made up of a rear part of the plate (5) itself. It can, in another embodiment, be mobile in respect to the plate (5). For this purpose, a transmission, makes it integral with the mechanism (24) which gives, in the first part of the phase of the rotation of the mobile seat (1), a movement lifting the pushing bar above the plate (5), before driving the plate in a combined movement in conjunction with the pushing bar and mobile seat, until the end of the upright positioning.

Another modification may concern the production of the seat which can be made up of a solid part. In this case, the rear part (16), is rotated around a pin situated close to the rear face of the plate (5) to which it is integral. When the plate (5) is lifted, the part (16), tilts backwards until it forms approximately a 90° angle with the plate (5) which it then accompanies in its movement.

The total depth of the seat of the armchair is defined as being the distance between the front face (39) of the back (35), at the level of the seat (16), and the vertical plane through the foremost point of the mobile seat (1) in the rest position.

The depth of the swivelling seat (1) is defined as being the distance between the plane through the foremost point of its front face (33) and the plane of the rear face (30) of the pushing bar. This depth is comprised of between one quarter and six sevenths of the total depth of the armchair seat.

The distance between the axis of the pairs of locations of the pin (28) and the summit of the angle of the faces (29) and (30) of the pushing bar (2) is comprised between 15 and 50 centimeters. FIGS. 9 to 11 illustrate simplified implementation of an armchair or seat.

This embodiment is obtained by positioning the pushing bar (2) on the front face (42) of the seat (43) which, in this case, is made of one part. The seat is rotated around a pin (44) parallel to its front face and situated in the back (45) of the armchair. The upright positioning and lifting device of the user (46) can more particularly, be an electric cylinder for example, which applies its effort between the pushing bar (2) and an anchoring point (46) localised in the front bottom part of the armchair or its framework.

In order to be lifted, the user positions himself as shown in FIG. (10) so that the pushing par (2) is infront of the bottom of his ischiums (4). He can then start the upright positioning device which he stops when he has reached the height he requires.

To sit down, the user lifts the pushing bar up to the height of sub femoral support, settles on to it and undergoes the lowering procedure. With this implementation, it is necessary to make sure that the seat is stable during the moving and lifting upright positioning (or as near to upright as possible) phase of the user.

For this purpose, the arc of the circle described by the pushing bar (2) must not project or only slightly beyond the front plane of the armchair legs. In addition, the highest position (for example sub femoral 84 cm long corresponding to a 1.85 m developed length) of the pushing bar must be in the vertical plane close to the vertical plane of the armchair.

These two requirements are fulfilled when the arrow (K) of the cirle of the arc described by the pushing bar (2), is as short as possible. Thus, the radius of the arc of the circle (Represented by the distance from the pushing bar to the axis (44)) must be as long as possible.

The rotation axis (44) of the seat on the back, must be placed at a height from the floor, close to the average height which the pushing bar reaches between its highest and lowest position.

This simplified implementation according to FIGS. 9 to 11, has certain advantages. In particular, it only requires one rotation axis to reach all the lifting up heights, comprises of a seat made in one part, suppresses the caliper type mechanism previously required, and enables the production of more diversified looking armchairs.

The arrangement of the cylinder (46) between the pushing bar (2) and the anchor (47) enables the same additional functions (illustrated in FIG. (7)) to be made with the same motor, i.e. to tilt and lift up the back of the armchair which is rotated around a pin (48), then tilt and lift up a leg rest (48) rotated on a pin (50).

Now, FIGS. 12 and 16 shall be refered to in a more general manner. The structure of the aforementioned upright positioning device as a whole by (51) is vertically fitted on an underframe (52) mounted for example, on rollers. The top part is designed so as to take the pushing bar (2) which is applied into the sub femoral area (3) and more particularly into the ischial-femoral angle (7) of the user. By referring to FIG. 16, the device comprises of at least one vertical column, mounted on an underframe on which a bush (53) slides from top to bottom and on which a bush (54) is horizontally made integral to, whose end takes the pushing bar (2). A cylinder (55) or simlar component is fixed to the underframe and the said bush and enables the pushing bar to be lifted up. Such a simplified device enables any user to use it to sit down on all appropriate conventional seating elements such as chairs, commodes and toilet aids, bidets, beds and other similar products.

The upright positioning structure enables the user to be positioned to all required height by means of height adjustments.

I claim:

1. A chair having movable means for bringing a sitting individual into a standing position comprising a seat, said seat having a first portion and a second portion therebehind in the same horizontal plane, said first portion of said seat having an outwardly and upwardly extending cross bar, said first portion of said seat being mounted on an arcuately movable frame, said arcuately movable frame being operatively connected to drivable linkage means mounted on said chair whereby said seat is arcuately movable about a horizontal axis disposed forwardly of said first portion of said seat, said cross bar being parallel to said horizontal axis and disposed rearwardly of said first portion of said seat, said cross bar being dimensioned and adapted and constructed to be positioned in lifting association of the sub femoral or ischial-femoral area of an occupier of said seat by pressing against the ischial projections of the occupier's pelvis to thereby provide resistance to sliding forward on the part of the occupier during lifting when support of the buttock and lumbar region of the occupier extends rearwardly of the seat beyond the said cross bar.

* * * * *